United States Patent [19]

Williams

[11] 4,017,970

[45] Apr. 19, 1977

[54] TILE AND TUB SCRAPER

[75] Inventor: Ann Williams, Chicago, Ill.

[73] Assignee: Lawrence Peska Associates, Inc., New York, N.Y. ; a part interest

[22] Filed: Oct. 6, 1975

[21] Appl. No.: 620,211

[52] U.S. Cl. ..... 30/169; 30/339; 15/143 R

[51] Int. Cl.[2] ..... A47L 13/08

[58] Field of Search ..... 15/104 S, 143 R, 236 R; 17/30, 31, 69; 30/169, 172, 338, 339

[56] References Cited

UNITED STATES PATENTS

| | | | |
|---|---|---|---|
| 673,506 | 5/1901 | Pitts | 15/143 R UX |
| 1,048,778 | 12/1912 | Wood | 15/143 R X |
| 1,317,316 | 9/1919 | Reed | 30/169 UX |
| 1,432,798 | 10/1922 | Spence | 15/236 R UX |
| 2,215,749 | 9/1940 | Bryan | 15/236 R X |

FOREIGN PATENTS OR APPLICATIONS

| | | | |
|---|---|---|---|
| 707,275 | 6/1941 | Germany | 15/236 R |
| 165,909 | 5/1932 | Switzerland | 30/339 |
| 209,182 | 6/1940 | Switzerland | 15/236 R |
| 106,742 | 9/1916 | United Kingdom | 30/339 |

*Primary Examiner*—Daniel Blum

[57] ABSTRACT

A novel tile and tub scraper is disclosed comprising two flat blade holders adapted to fit in the palm of the hand and having a scraper blade secured between the blade holders. One blade holder has a horizontal groove thereon for gripably receiving a forefinger where the other blade holder has an indentation substantially vertical to the groove for gripably receiving a thumb, the edge of the scraper blade substantially horizontal to said groove.

3 Claims, 3 Drawing Figures

TILE AND TUB SCRAPER

SUMMARY OF THE INVENTION

The present invention relates to a novel hand held scraper comprising a first and second blade holder, the first blade holder having a substantially horizontal groove in the surface thereof that faces outwardly for gripably receiving an index finger, the second blade holder being adapted to fit flushly against the first blade holder whereby a scraper blade such as a safety razor blade may be positioned between the two. The second holder has an indentation in the surface thereof that faces outwardly for gripably receiving a thumb, the indentation being substantially vertical with respect to the horizontal groove. The scraper is arranged to receive a scraper blade when the first and second blade holder are aligned so that the exposed edge of the scraper blade is substantially parallel to the groove. Pins are provided to secure the first and second blade holder together and to pass through the scraper blade to prevent the blade from moving during use, the pins being of a configuration so that they fit flushly in the openings provided in the scraper blade.

DETAILED DESCRIPTION

Many scraper devices are known in the prior art for cleaning flat surfaces or for removing various layers from such surfaces. The scrapers disclosed in this respect are not readily adapted to doing fine closely controlled hand work because their handles are adapted to be grasped in the palm of the hand which prevents manipulation that is readily and easily controlled by finger movement. The prior art also does not provide a scraper that is adapted to being easily grasped or gripped by fingers and were more force is required to be applied to a working surface on which the scraper is being used can also be urged in the direction of the surface to be worked by the heel of the hand.

It is therefore an object of the present invention to overcome these and other difficulties encountered in the prior art.

It is a further object of the present invention to provide a novel hand held scraper that is readily gripped by the fingers and especially one that is easily manipulated by the forefinger and thumb and which can be further urged in the direction of a work surface by the heel of the hand.

These and other objects have been achieved by the apparatus of the present invention which will become apparent by reference to the disclosure and claims that follow as well as the appended drawing.

The present invention comprises a novel scraping apparatus and in one embodiment first and second blade holders are provided which may be made of wood about two inches by two and three-quarters inch by about one quarter inch thick and have a blade mounted between them. The scraper may be used as a tile and tub scraper to remove all or any grime that may accumulate on tile or tub surfaces even after these surfaces have been scrubbed with household cleansers. The scraper of the present invention is especially useful in this application since very light wrist action or movement of the scraper with the thumb and forefingers peels off grime an dirt fast. The scraper may also be used by carpenters or wood refinishers to scrape wood or varnished surfaces or it can be used as a cutting tool. The scraper is also small enough to fit into a pocket on a shirt or other article of clothing or it can optionally have a clip mounted thereon in one preferred embodiment for securing it to a pocket. The scraper can also be used in sewing in lieu of scissors and can be supplied in any of a variety of decorative colors.

Figure 1:
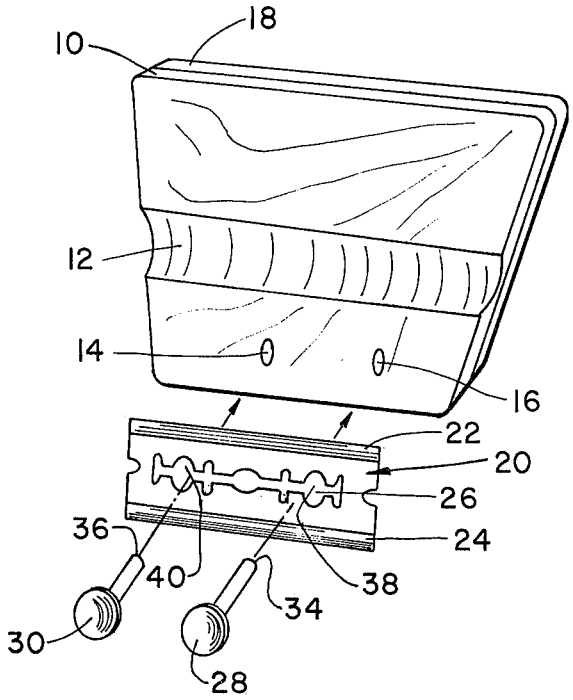
FIG. 1 is an exploded view in perspective illustrating one embodiment of the scraper of the present invention.
Figure 2:
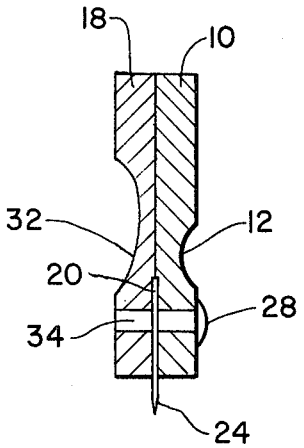
FIG. 2 is a side elevation in section of one embodiment of the scraper of the present invention.
Figure 3:
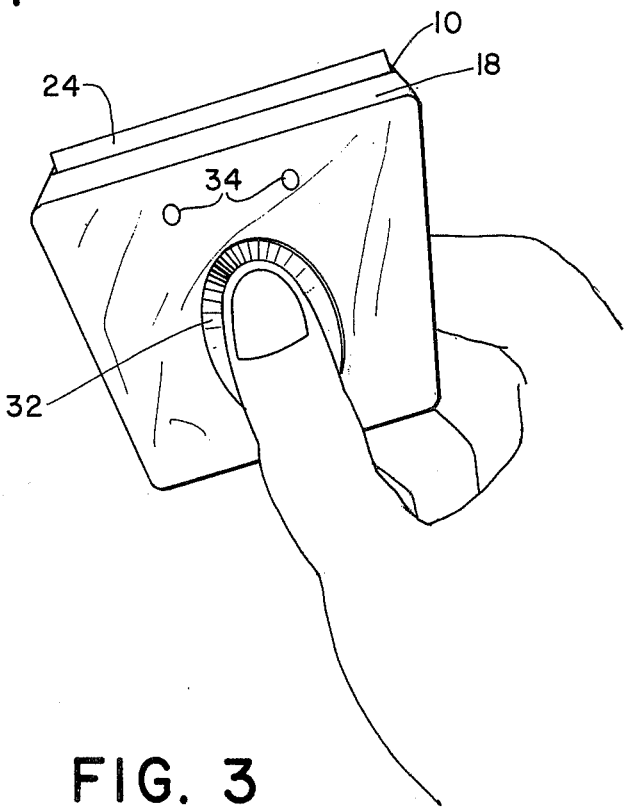
FIG. 3 is a perspective view of one embodiment of the scraper of the present invention illustrating how the scraper is manually grasped during use.

FIGS. 1 through 3 illustrate the scraper which comprises a first blade holder means having a flat surface. The first holder also has a recessed surface along one side for abuttingly receiving the side of a scraper blade 20, blade holder 10 having a substantially horizontal concave groove 12 facing outwardly of the scraper assembly and opposite the flat surface. Groove 12 is adapted to gripably receive a forefinger. The flat surface of blade holder 10 is abuttingly positioned against the flat surface of a second blade holder 18 which latter holder also has a recessed surface adapted to receive the side of a scraper blade 20 and which is in opposite alignment to the recessed surface of blade holder 10. Second blade holder 18 has a concave indentation 32 thereon opposite its flat surface on which the scraper blade abuts, indentation 32 being adapted to gripably receive a thumb, said indentation being substantially vertical to groove 12. First blade holder 10 and second blade holder 18 are positioned so that the flat surfaces of each abut one another flushly for positioning a scraper blade 20 between the recessed surfaces so that the edge of the blade is exposed and is substantially parallel to groove 12. Removable pins are provided comprising a first pin having a shank 34 and a head 28 and a second pin having a shank 36 and a head 30, said first pin being inserted through hole 16 and said second pin being inserted in hole 14 in blade holder 10. The first pin and the second pin pass through openings 38 and 36 in blade 20, these openings being a part of the universal opening 26 in blade 20 adapted to receive a variety of pins for holding and aligning blade 20 securely. The shanks 34 and 36 of the first and second pins are shaped to fit openings 14 and 16 securely and to flushly engage the openings 38 and 40 in blade 20 so that when the blade is positioned in the scraper of the present invention it will not be displaced during any scraping operation the shanks 34 and 36 of the pins are adapted to flushly fit through any two openings in the universal opening 26 in razor blade 20 for preventing the blade from moving in said scraper. The first and the second pins also pass through openings in the second blade holder 18 and thereby secure the assembly or blade holder 10 and 18 together with blade 20 sandwiched in between the holders and secured from moving by the first and second pins. In one embodiment the scraper blade 20 comprises a safety razor blade having edges 22 and 24 which can be reversed when one edge is dulled.

In use, the scraper of the present invention is preferably of a size sufficient to fit into the palm of the hand so that it is readily and easily grasped between the thumb and forefinger and when presented in a scraping relation to a work surface can be easily manipulated and moved about by controlling it with the thumb and forefinger. This particular size is also desired in the event an obstacle is encountered on a work surface against which the blade is being applied since if the blade cannot be properly moved by the forefinger and thumb against the obstacle, the blade holder can be braced against the heel of the hand and the blade at the opposite end thereof can be urged forward by the application of pressure on the heel of the hand.

Although the invention has been described by reference to some embodiments it is not intended that the novel scraper be limited thereby, but that certain modifications are intended to be included within the broad scope and spirit of the foregoing disclosure, the following claims and the appended drawing.

What is claimed is:

1. A hand held scraper comprising a first flat blade holder means having a flat surface, said first blade holder having a substantially horizontal concave groove on the surface opposite said flat surface for gripably receiving a forefinger, said flat surface of said first blade holder abuttingly positioned against the flat surface of a second flat blade holder, said second blade holder having a concave indentation thereon opposite its flat surface for gripably receiving a thumb, said indentation being substantially vertical to said groove, said first blade holder and said second blade holder having opposed recessed surfaces along one side, said holders being positioned so that the flat surfaces of each abut one another flushly for positioning a scraper blade between said recessed surfaces so that the edge of said blade is exposed and substantially parallel to said groove, removable pin means securingly inserted through said first and second holders for attaching said holders to one another and holding a scraper blade in a fixed position in said scraper, said first and second blade holders being of a size sufficient to fit in the palm of the hand so that said scraper may be manipulated by the thumb and forefinger and optionally may be urged towards a work surface by the heel of the hand.

2. The hand held scraper of claim 1, wherein said scraper comprises a safety razor blade having opening means therein for receiving said pin means, said pin means being adapted to flushly fit through said opening means in said blade for preventing said blade from moving in the scraper.

3. The hand held scraper of claim 2 wherein said scraper comprises a double edged safety razor blade having a universal opening therein for receiving two of said pin means, said pin means being adapted to flushly fit through two openings in said universal opening for preventing said blade from moving in said scraper.

* * * * *